US010031453B2

(12) United States Patent
Yamano et al.

(10) Patent No.: US 10,031,453 B2
(45) Date of Patent: Jul. 24, 2018

(54) FIXING APPARATUS AND IMAGE FORMING APPARATUS INCLUDING A COVERING UNIT WITH A MOVABLE UNIT FOR EFFECTIVE HEATING

(71) Applicant: Konica Minolta, Inc., Chiyoda-ku, Tokyo (JP)

(72) Inventors: Miho Yamano, Kokubunji (JP); Hiroyuki Maeda, Toyokawa (JP); Dai Suwama, Hachioji (JP); Midori Shimomura, Hino (JP); Tsuyoshi Tamaru, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/333,260

(22) Filed: Oct. 25, 2016

(65) Prior Publication Data

US 2017/0123355 A1 May 4, 2017

(30) Foreign Application Priority Data

Oct. 30, 2015 (JP) ..... 2015-213573

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2078; G03G 15/2039; G03G 15/2017
USPC ..... 399/328
See application file for complete search history.

(56) References Cited

U.S. PATENT DOCUMENTS 3,926,429 A * 12/1975 Satomi ..... G03G 15/6532 271/259
9,152,097 B2 * 10/2015 Nojima ..... G03G 15/2025
2014/0376980 A1 * 12/2014 McDavid ..... G03G 15/2007 399/334
2016/0349683 A1 * 12/2016 Maeda ..... G03G 15/2017

FOREIGN PATENT DOCUMENTS

JP 2004109626 A 4/2004
JP 2004-287318 A 10/2004

OTHER PUBLICATIONS

Japanese Office Action("Notification of Refusal") dated Oct. 17, 2017, by the Japanese Patent Office in corresponding Japanese Patent Application No. 2015-213573 (9 pages).

* cited by examiner

*Primary Examiner* — Walter L Lindsay, Jr.
*Assistant Examiner* — Arlene Heredia Ocasio
(74) *Attorney, Agent, or Firm* — Buchanan Ingersoll & Rooney PC

(57) ABSTRACT

A fixing apparatus includes the following. A heating unit includes an outer surface driven to rotate and heats a sheet on which color material is transferred. A reflecting unit reflects heat emitted from the heating unit. The reflecting unit further includes, a covering unit which covers at least a portion of the outer surface of the heating unit so that there is a predetermined space; and a movable unit which is provided in the covering unit and which can be switched between a first position and a second position in which air in the space can flow more easily than the first position. The fixing apparatus also includes, a switching unit which switches the movable unit between the first position and the second position; and a controller which controls the switching unit.

9 Claims, 8 Drawing Sheets

FIXING APPARATUS AND IMAGE FORMING APPARATUS INCLUDING A COVERING UNIT WITH A MOVABLE UNIT FOR EFFECTIVE HEATING

BACKGROUND OF THE INVENTION

Field of the Invention

The present invention relates to a fixing apparatus and an image forming apparatus.

Description of Related Art

Conventionally, an image forming apparatus employing the electro-photographic method includes a fixing apparatus which fixes color material (toner) transferred from an image carrier (photoreceptor drum, intermediate transfer belt, etc.) to a sheet by applying heat and pressure. A well-known fixing apparatus is provided with reflecting plates and heat insulating plates around the heating unit in order to enhance heating efficiency in the fixing apparatus.

For example, Japanese Patent Application Laid-Open Publication No. 2004-109626 proposes a fixing apparatus provided with a concave/convex portion in a portion of the reflecting plate provided surrounding the heating unit to face the heating unit in order to prevent natural convection between the heating unit and the reflecting plate. In such fixing apparatus, it is possible to suppress the flow of air in the circling direction of the heating unit and to prevent the hot air heated by the heating unit from going outside.

However, when the reflecting plate provided with a concave/convex portion as described in the conventional technique is employed, the concave/convex portion prevents the flow of air between the reflecting plate and the heating unit. Therefore, the warm air filled around the heating unit when the temperature of the heating unit rises too high is not discharged and a certain amount of time is necessary to return the temperature to a suitable temperature.

As described above, there are points for modification in the fixing apparatus provided with a concave/convex portion in the portion of the reflecting plate facing the heating unit from the viewpoint of controlling the temperature of the heating unit.

BRIEF SUMMARY OF THE INVENTION

The present invention has been made in consideration of the above problems, and one of the main objects is to suitably control the temperature of a heating unit.

According to one aspect of the present invention, there is provided a fixing apparatus including: a heating unit which includes an outer surface driven to rotate and which heats a sheet on which color material is transferred; a reflecting unit which reflects heat emitted from the heating unit, wherein the reflecting unit further includes: a covering unit which covers at least a portion of the outer surface of the heating unit so that there is a predetermined space; and a movable unit which is provided in the covering unit and which can be switched between a first position and a second position in which air in the space can flow more easily than the first position; a switching unit which switches the movable unit between the first position and the second position; and a controller which controls the switching unit.

Preferably, in the fixing apparatus, the movable unit is provided rotatable around a first portion in contact with the covering unit as an axis; and the second position is a position in which a second portion of the movable unit opposite of the first portion is farther from the heating unit than the first position.

Preferably, in the fixing apparatus, the axis of rotation of the movable unit is substantially orthogonal to a rotating direction of the heating unit.

Preferably, in the fixing apparatus, wherein, the movable unit is provided to project and retreat from an internal surface of the covering unit on the heating unit side; the first position is a position in which the movable unit projects more toward the heating unit than an internal surface of the covering unit; and the second position is a position in which the movable unit retreats to a direction opposite of the heating unit than the first position.

Preferably, in the fixing apparatus, the reflecting unit is divided into a plurality of regions along a direction of an axis of rotation of the heating unit; and the controller controls the switching unit to switch the movable unit included in each region between the first position and the second position for each region of the plurality of regions.

Preferably, in the fixing apparatus, the controller controls the switching unit to switch the movable unit from the first position to the second position when a temperature of the heating unit is decreased.

Preferably, the fixing apparatus further includes a jamming detecting unit which detects jamming of a sheet conveyed in the fixing apparatus, wherein, the controller controls the switching unit to switch the movable unit from the first position to the second position when the jamming detecting unit detects jamming.

Preferably, in the fixing apparatus, the controller controls the switching unit to switch the movable unit between the first position and the second position depending on a type of the sheet as a target of fixing.

According to another aspect of the present invention, there is provided an image forming apparatus including the fixing apparatus according to the above aspect.

BRIEF DESCRIPTION OF THE DRAWINGS

The present invention will become more fully understood from the detailed description given hereinbelow and the appended drawings, and thus are not intended to define the limits of the present invention, and wherein.

DETAILED DESCRIPTION OF PREFERRED EMBODIMENTS

An embodiment of the image forming apparatus of the present invention is described with reference to the drawings. The present invention is not limited to the illustrated examples.

First Embodiment

Figure 1:
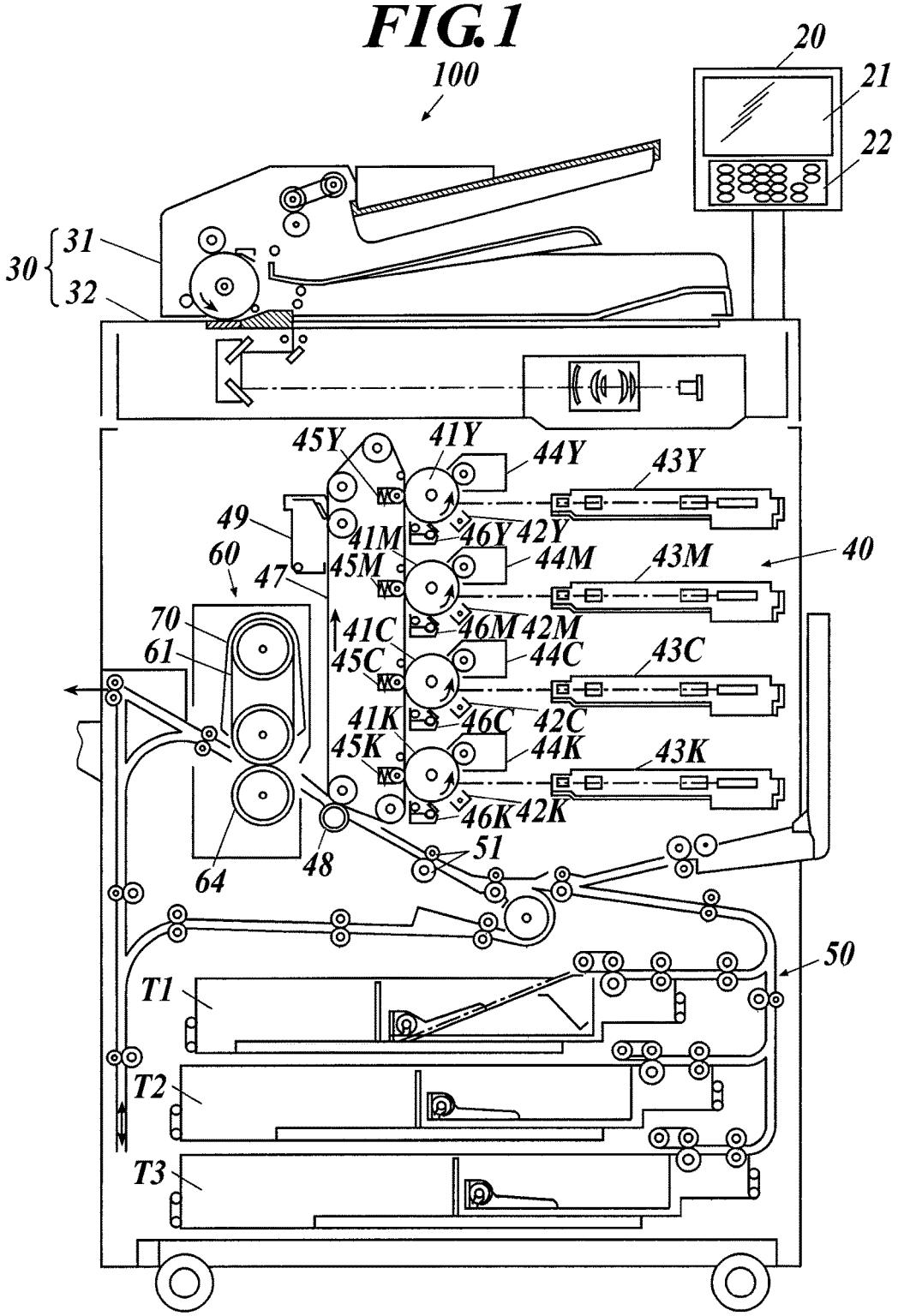
FIG. 1 is a schematic cross-sectional view showing an entire configuration of an image forming apparatus of a first embodiment of the present invention.
Figure 2:
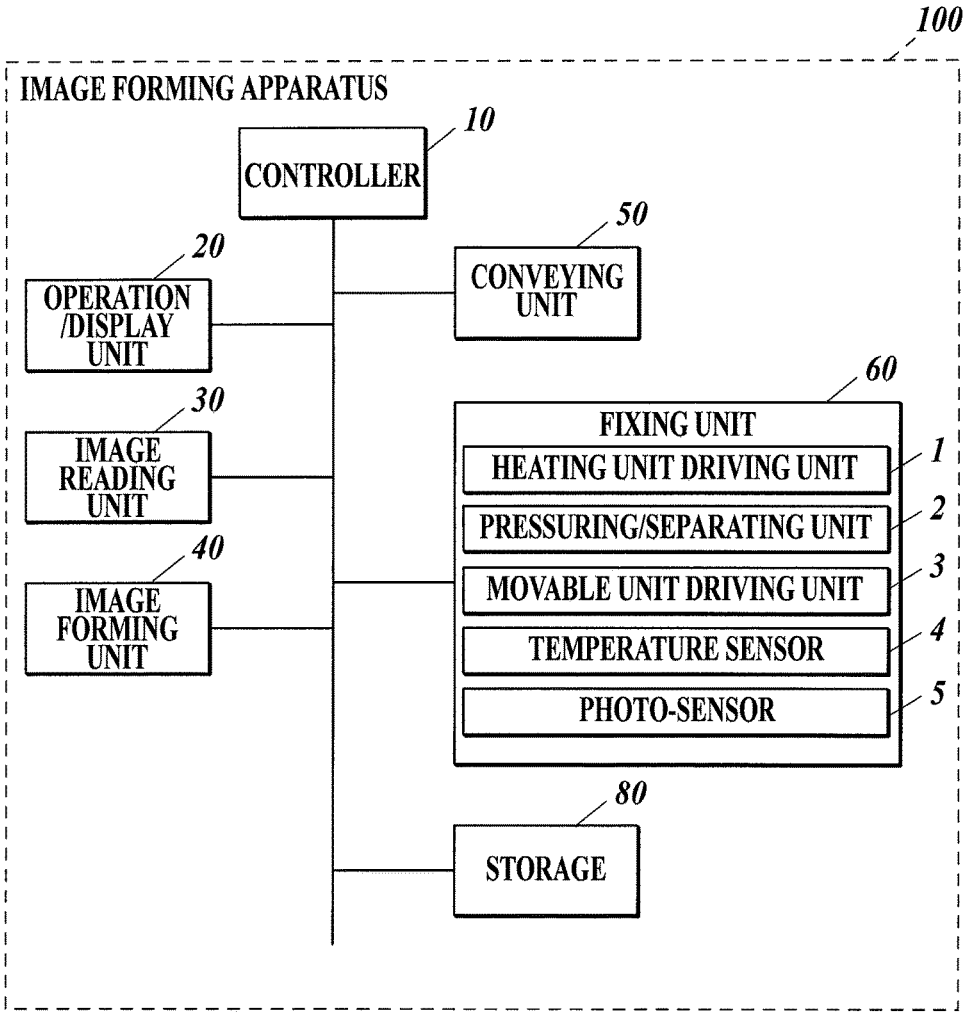
FIG. 2 is a block diagram showing a functional configuration of an image forming apparatus.

The configuration of the apparatus of the image forming apparatus 100 of the first embodiment of the present invention is described with reference to FIG. 1 and FIG. 2. FIG. 1 is a schematic cross-sectional diagram showing an entire configuration of the image forming apparatus 100. FIG. 2 is a block diagram showing a functional configuration of the image forming apparatus 100.

The image forming apparatus 100 is a tandem-type image forming apparatus which forms a color image by an electrophotographic method based on image data obtained by reading an image from a document or image data received from an external device.

The image forming apparatus 100 includes a controller 10, an operation/display unit 20, an image reading unit 30, an image forming unit 40, a conveying unit 50, a fixing unit 60, a storage 80, and the like.

The controller 10 includes a CPU (Central Processing Unit), a ROM (Read Only Memory), a RAM (Random Access Memory), etc. The CPU reads out various programs stored in the ROM and deploys the above in the RAM. The CPU centrally controls the operation of each unit in the image forming apparatus 100 based on the deployed program.

The operation/display unit 20 includes a display unit 21 and an operation unit 22.

The display unit 21 includes a LCD (Liquid Crystal Display) etc., and displays various screens according to an instruction of a display signal input from the controller 10.

The operation unit 22 includes a touch panel formed so as to cover the display screen of the display unit 21, and various operation buttons such as a numeric button, start button, etc. The operation signal based on the user operation is output to the controller 10. The operation unit 22 receives the operation instruction from the user.

The image reading unit 30 includes an ADF (Auto Document Feeder) 31, and scanner 32.

The ADF 31 automatically feeds the document placed on the document tray.

The scanner 32 optically scans the document conveyed to the contact glass from the ADF 31 or the document placed on the contact glass, images the reflected light from the light which is emitted from the optical source to scan the document on the light receiving surface of the sensor CCD (Charge Coupled Device), reads the document image, performs A/D conversion of the read image, and outputs the obtained image data to the controller 10.

The image forming unit 40 includes photoreceptor drums 41Y, 41M, 41C, 41K corresponding to each color yellow (Y), magenta (M), cyan (C), black (K); charging units 42Y, 42M, 42C, 42K; exposing units 43Y, 43M, 43C, 43K; developing units 44Y, 44M, 44C, 44K; primary transfer rollers 45Y, 45M, 45C, 45K; photoreceptor cleaning units 46Y, 46M, 46C, 46K; an intermediate transfer belt 47; a secondary transfer roller 48; and a belt cleaning unit 49.

The charging units 42Y, 42M, 42C, 42K charge the photoreceptor drums 41Y, 41M, 41C, 41K entirely.

The exposing units 43Y, 43M, 43C, 43K each include a laser source, a polygon mirror, a lens, etc., and each unit scans the surface of the respective photoreceptor drum 41Y, 41M, 41C, 41K to be exposed to a laser beam to form an electrostatic latent image based on the image data of each color.

The developing units 44Y, 44M, 44C, 44K apply toner of each color to the electrostatic latent image on the photoreceptor drums 41Y, 41M, 41C, 41K, and develop the image.

The primary transfer rollers 45Y, 45M, 45C, 45K sequentially transfer the toner image of each color formed on the photoreceptor drums 41Y, 41M, 41C, 41K on the intermediate transfer belt 47 (primary transfer). That is, the color toner image with the toner images of 4 colors overlapped on each other is formed on the intermediate transfer belt 47.

The secondary transfer roller 48 collectively transfers the color toner image on the intermediate transfer belt 47 onto one surface of the sheet supplied from the sheet feeding trays T1, T2, T3 (secondary transfer).

The photoreceptor cleaning units 46Y, 46M, 46C, 46K remove toner remaining on the surface of the photoreceptor drums 41Y, 41M, 41C, 41K after transfer.

The belt cleaning unit 49 removes the residual toner from the intermediate transfer belt 47 after the color toner image is transferred onto the sheet by the secondary transfer roller 48.

The conveying unit 50 includes a registration roller 51, a conveying roller to convey the sheet, etc. and conveys the sheet in the image forming apparatus 100 from when the sheet stored in the sheet feeding trays T1, T2, T3 is supplied to the image forming unit 40 to when the sheet with the fixed image is ejected outside the apparatus. The sheet feeding trays T1, T2, T3, store the sheets with the sheet type and size predetermined for each sheet feeding tray.

The fixing unit 60 fixes on the sheet the toner as color material transferred on the sheet by applying heat and pressure.

The fixing unit 60 includes a heating unit driving unit 1, a pressuring/separating unit 2, a movable unit driving unit 3, a temperature sensor 4, a photo-sensor 5, etc.

The storage 80 includes a nonvolatile storage apparatus such as a hard disk, flash memory, etc. and stores various data. For example, the storage 80 stores the fixing temperature corresponding to various sheet types (thick sheet, normal sheet, thin sheet, etc.). The fixing temperature is the temperature necessary to melt the toner when the sheet passes the nipping portion in the fixing unit 60, and the temperature is different according to the sheet type, etc. of the sheet on which the image is formed.

Figure 3A:
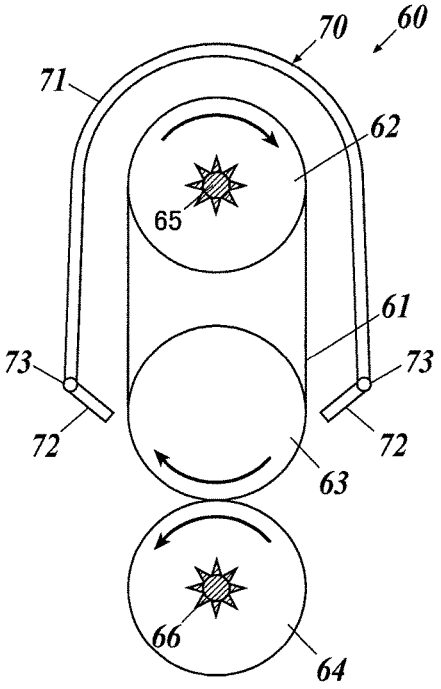
FIG. 3A is a schematic diagram showing a cross-sectional configuration of a fixing unit when fixed.
Figure 3B:
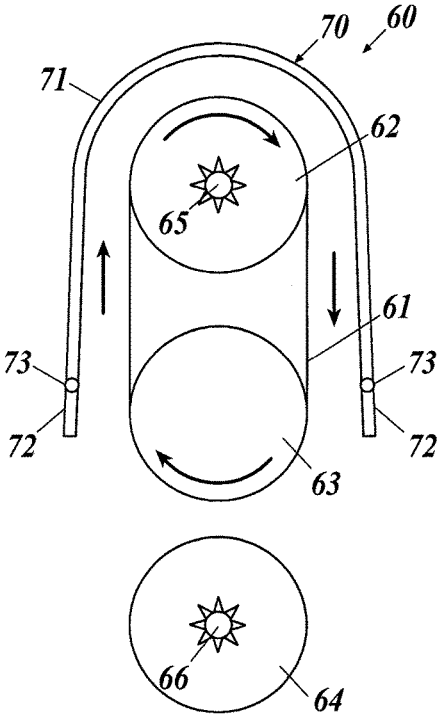
FIG. 3B is a schematic diagram showing a cross-sectional configuration of a fixing unit when cooled.

FIG. 3A and FIG. 3B schematically show a cross-sectional configuration of the fixing unit 60.

The fixing unit 60 includes a fixing belt 61 as a heating unit, a heating roller 62, an upper pressure roller 63, a lower pressure roller 64, a reflecting unit 70, etc.

The fixing belt 61 is provided wrapped around the heating roller 62 and the upper pressure roller 63, and includes an outer surface which is driven to rotate. The fixing belt 61 comes into contact with the sheet with the toner transferred and heats the sheet at a fixing temperature. For example, the fixing belt 61 includes a base formed from polyimide, etc. with an elastic layer formed from silicon rubber, etc. and a surface layer made from PFA, etc. layered in order.

The heating roller 62 heats the fixing belt 61 so that the sheet is heated at a predetermined temperature with the fixing belt 61, that is, so that the temperature of the fixing belt 61 is to be the fixing temperature. For example, the heating roller 62 includes a cylinder core metal with a resin layer made from PTFE, etc. formed on the outer surface. In the heating roller 62, the heaters 65 such as a halogen heater, etc. are internally provided in a plurality of positions in the axis direction of the heating roller 62. The heaters 65 heat the heating roller 62 in the corresponding positions in the axis direction of the heating roller 62. As a result, the corresponding position in the width direction of the heating belt 61 is heated.

A temperature sensor 4 to measure the temperature of the fixing belt 61 is positioned near the fixing belt 61. The temperature sensor 4 includes a thermocouple, etc., and a plurality of temperature sensors 4 are positioned in the width direction of the sheet. The controller 10 controls the output of the heater 65 in the positions corresponding to the temperature sensors 4 so that the temperature measured by the temperature sensors 4 matches with the predetermined temperature necessary for fixing. The temperature of the fixing belt 61 is controlled within a certain range such as 160 to 200° C.

The upper pressure roller 63 is positioned opposite the lower pressure roller 64 to form a nipping portion between the fixing belt 61 and the lower pressure roller 64. For example, the upper roller 63 includes a cylinder core metal with an elastic layer formed from silicon rubber, etc. and a surface layer formed from PTFE, etc. formed on the outer surface.

The heating unit driving unit 1 rotates the heating roller 62 or the upper pressure roller 63 to drive the rotation of the fixing belt 61. The controller 10 controls driving of the heating unit driving unit 1.

The lower pressure roller 64 is pressed toward the upper pressure roller 63 with the fixing belt 61 in between by the pressuring/separating unit 2. The pressuring/separating unit 2 includes an energizing unit which energizes the lower pressure roller 64 to the upper pressure roller 63, so that the lower pressure roller 64 is pressed to the fixing belt 61 during fixing and separates the lower pressure roller 64 from the fixing belt 61 when the apparatus is not in use or during cooling. The pressuring/separating unit 2 can switch the load in multiple levels when the lower pressure roller 64 is pressed against the upper roller 63 according to the sheet type, basis weight, size, etc. of the sheet used in image forming. The controller 10 controls the driving of the pressuring/separating unit 2.

For example, the lower pressure roller 64 includes a cylinder core metal with an elastic layer formed from silicon rubber, etc. and a surface layer formed from PFA, etc., formed on the outer surface. The lower pressure roller 64 includes a heater 66 such as a halogen heater and heats the sheet passing through the nipping unit together with the fixing belt 61. The temperature of the lower pressure roller 64 is controlled within a certain range such as 80 to 120° C.

The reflecting unit 70 reflects the heat emitted from the fixing belt 61. The reflecting unit 70 includes a covering unit 71 which covers a portion of the outer surface of the fixing belt 61 so that there is a predetermined space, and a movable unit 72 provided in the covering unit 71.

The covering unit 71 includes metal such as stainless steel, and mirror finishing is provided on the internal surface of the covering unit 71.

The movable unit 72 is provided in an opening (edge) of the covering unit 71 so as to be rotatable around the portion in contact with the covering unit 71 as the axis (first portion, hinge 73). The rotating axis of the movable unit 72 is substantially orthogonal to the rotating direction of the fixing belt 61. That is, the rotating axis of the movable unit 72 is positioned to extend in the direction substantially orthogonal to the sheet face of FIG. 3A and FIG. 3B. Here, substantially orthogonal means the angle between the rotating axis of the movable unit 72 and the rotating direction of the fixing belt 61 do not have to be strictly 90° C.

The movable unit 72 can be switched between a first position shown in FIG. 3A and a second position shown in FIG. 3B. The first position is a position in which the movable unit 72 is standing toward the fixing belt 61 than the second position, that is, the edge of the movable unit 72 opposite of the hinge 73 is in a position closer to the fixing belt 61 than the second position. The second position is a position in which the flow of air in the space between the fixing belt 61 is smoother than the first position (that is, a position in which the edge (second portion) of the movable unit 72 opposite to the hinge 73 is farther from the fixing belt 61 than the first position), and a position in which the movable unit 72 is continued with the internal surface of the covering unit 71.

The covering unit 71 is provided in the width direction of the fixing belt 61. One movable unit 72 can be provided throughout the width direction of the fixing belt 61 or a plurality of movable units 72 can be provided along the width direction of the fixing belt 61.

The movable unit driving unit 3 switches the position of the movable unit 72 between the first position and the second position. The movable unit driving unit 3 functions as a switching unit. The movable unit driving unit 3 includes a rotating actuator (motor, etc.) in which the rotating angle is 60 degrees. The movable unit driving unit 3 moves the movable unit 72 to a position so that the edge of the movable unit 72 opposite to the hinge 73 is relatively close to the fixing belt 61 (first position) or to a position so that the edge of the movable unit 72 opposite to the hinge 73 is relatively separated from the fixing belt 61 (second position).

The controller 10 controls the movable unit driving unit 3. Specifically, the controller 10 controls the movable unit driving unit 3 so that the movable unit 72 switches from the first position to the second position when the temperature of the fixing belt 61 is decreased. The fixing apparatus of the present invention includes the controlling unit 10 and the fixing unit 60.

The photo-sensor 5 detects whether there is a sheet in the setting position of the photo-sensor 5 to detect whether the sheet conveyed in the fixing unit 60 is jammed, and outputs the result to the controller 10.

Next, the operation of the fixing unit 60 is described.

According to the first embodiment, the job for the thin sheet (80 g/m$^2$) is performed directly after performing a job for the thick sheet (300 g/m$^2$). The fixing temperature when the thick sheet passes is 200° C., and the fixing temperature when the thin sheet passes is 160° C.

As shown in FIG. 3A, when the thick sheet passes, the controller 10 controls the movable unit driving unit 3 so that the movable unit 72 is standing toward the fixing belt 61 (first position).

The controller 10 controls the heaters 65, 66 so that the fixing temperature is 200° C. based on the output result of the temperature sensor 4. The controller 10 successively passes 200 sheets of thick sheets in the state that the fixing temperature is 200° C. The fixing rate (line rate) at this time is 400 mm/s.

In order to pass the thin sheet after the above, the temperature needs to be lowered to 160° C. Here, if the movable unit 72 remains standing, the decrease of the temperature of the fixing belt 61 is delayed, and much time is consumed until the temperature becomes a suitable temperature.

Therefore, during cooling, after turning off the heaters 65, 66, the controller 10 controls the movable unit driving unit 3 so that the movable unit 72 is in a laid down state (second position) as shown in FIG. 3B, and the warm air is ejected outside.

Further, the controller 10 controls the pressuring/separating unit 2 so that the lower pressure roller 64 releases contact with the fixing belt 61, the controller 10 controls the heating unit driving unit 1 so that the fixing belt 61 idly rotates at a speed faster than the normal fixing speed (500 mm/s). With this, the temperature of the fixing belt 61 can be decreased faster.

After the temperature decreases to 160° C., when the thin sheet passes, the controller 10 controls the movable unit driving unit 3 so that the movable unit 72 is in a state standing toward the fixing belt 61 again (first position). The controller 10 controls the pressuring/separating unit 2 so that the lower pressure roller 64 is pressed against the fixing belt 61, and controls the heating unit driving unit 1 so that the fixing belt 61 rotates at a fixing speed of 400 mm/s.

Conventionally, in order to lower the temperature of each unit to 160° C. so that the thin sheet can pass after the thick sheet passes, about 90 seconds were needed. However, by passing air between the reflecting unit 70 and the fixing belt 61, the time necessary for cooling becomes about 50 seconds, and the time can be shortened about 40 seconds.

As described above, according to the first embodiment, the position of the movable unit 72 is switched so that the temperature of the fixing belt 61 (heating unit) can be suitably controlled. For example, by switching the position of the movable unit 72 from the first position to the second position, the cross-sectional area of the flow path for the air can be enlarged with the covering unit fixed. By controlling the flow of the air between the fixing belt 61 and the reflecting unit 70 as described above, the temperature of the fixing belt 61 can be easily controlled.

Specifically, as shown in FIG. 3A, when the movable unit 72 is in the first position, this shape prevents the flow of air along the rotating direction of the fixing belt 61. Turning to FIG. 3B, when the movable unit 72 is in the second position, the flow of air along the rotating direction of the fixing belt 61 is enhanced. Therefore, the functions of maintaining temperature and releasing heat of the fixing unit 60 can both be realized.

Since the rotating axis of the movable unit 72 is substantially orthogonal to the rotating direction of the fixing belt 61, when the movable unit 72 is in the first position, it is possible to efficiently prevent the flow of air.

Second Embodiment

Next, the second embodiment applying the present invention is described.

The image forming apparatus of the second embodiment has a configuration similar to the image forming apparatus 100 shown in the first embodiment. Therefore, FIG. 1 and FIG. 2 are cited here, and the illustration and the description of the configuration similar to the image forming apparatus 100 are omitted. The characteristic configuration and operation of the second embodiment is described below.

The image forming apparatus of the second embodiment includes a fixing unit 160 instead of the fixing unit 60, and therefore, the fixing unit 60 in the drawings is considered to be the fixing unit 160.

The fixing unit 160 includes a heating unit driving unit 1, a pressuring/separating unit 2, a movable unit driving unit 3, a temperature sensor 4, a photo-sensor 5, etc. (see FIG. 2).

Figure 4C:
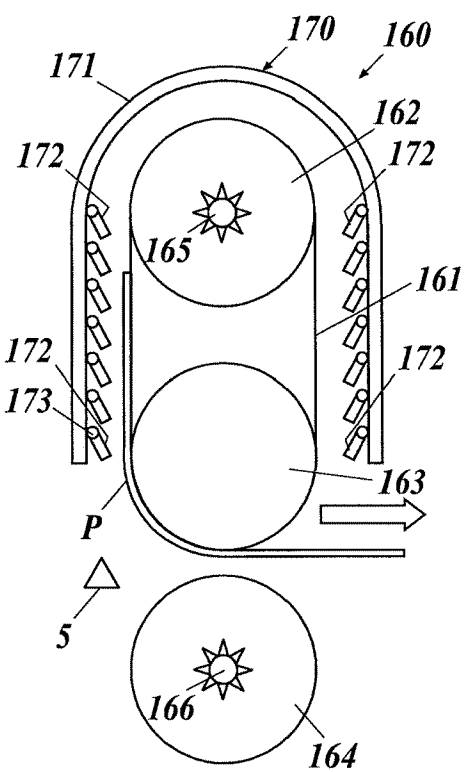
FIG. 4C is a schematic diagram showing a cross-sectional configuration of the fixing unit when the sheet is removed.
Figure 4B:
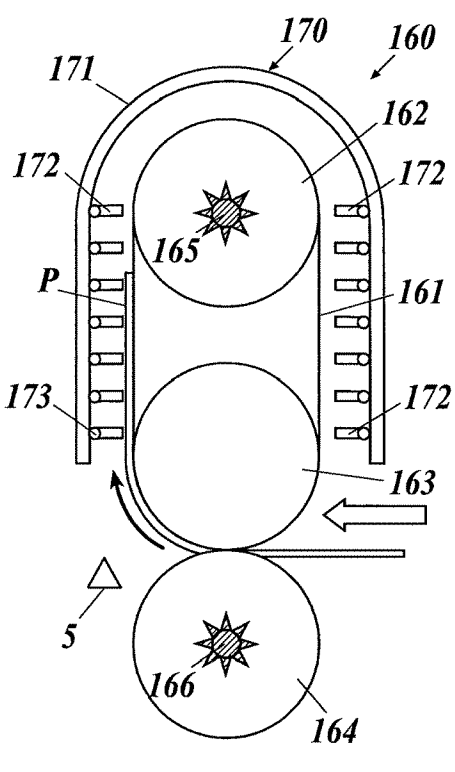
FIG. 4B is a schematic diagram showing a cross-sectional configuration of the fixing unit when jamming occurs.
Figure 4A:
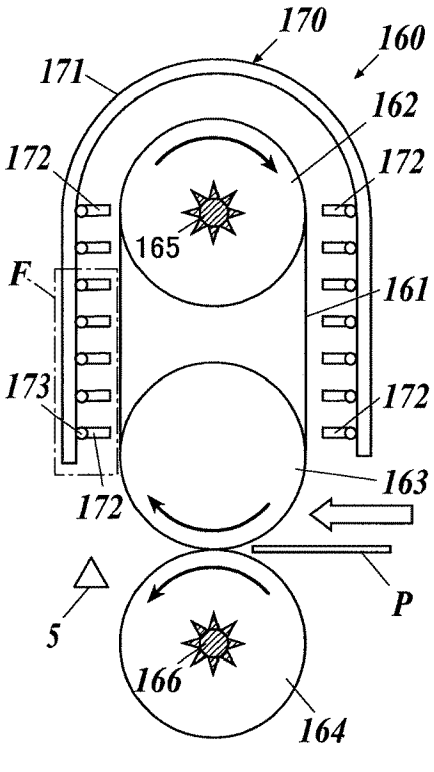
FIG. 4A is a schematic diagram showing a cross-sectional configuration of a fixing unit of an image forming apparatus of a second embodiment when fixed.

FIG. 4A, FIG. 4B, and FIG. 4C schematically show a cross-sectional configuration of a fixing unit 160.

The fixing unit 160 includes a fixing belt 161 as a heating unit, a heating roller 162, an upper pressure roller 163, a lower pressure roller 164, a reflecting unit 170, etc. The heating roller 162 internally includes heaters 165 in a plurality of positions along an axis direction of the heating roller 162. The heater 166 is included inside the lower pressure roller 164.

The fixing belt 161, the heating roller 162, the upper pressure roller 163, the lower pressure roller 164, and the heaters 165, 166 are similar to the fixing belt 61, the heating roller 62, the upper pressure roller 63, the lower pressure roller 64, and the heaters 65, 66, provided in the image forming apparatus 100 of the first embodiment, and therefore, the description is omitted.

The reflecting unit 170 reflects the heat from the fixing belt 161. The reflecting unit 170 includes a covering unit 171 which covers a portion of the outer surface of the fixing belt 161 so that there is a predetermined space and a movable unit 172 provided in the covering unit 171.

The covering unit 171 includes a metal such as stainless steel, and mirror finishing is provided on the internal surface of the covering unit 171.

Figure 5A:
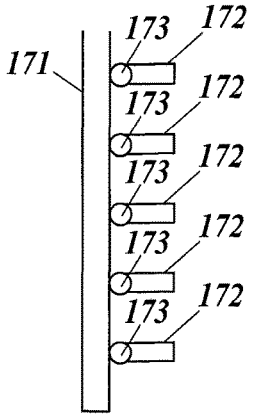
FIG. 5A is an enlarged diagram of a portion F of a reflecting unit shown in FIG. 4A.

FIG. 5A is an enlarged diagram of a portion F of a reflecting unit 170 shown in FIG. 4A.

Figure 5B:
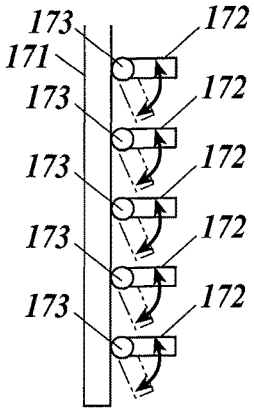
FIG. 5B is a diagram showing a movable unit rotating.

A plurality of movable units 172 are provided in the internal surface of the covering unit 171 so as to be rotatable around the portion in contact with the covering unit 171 (first portion, hinge 173) as the axis. The rotating axis of the movable unit 172 is substantially orthogonal to the rotating direction of the fixing belt 161. FIG. 5B is a diagram showing the movable unit 172 in a rotating state, and FIG. 5C shows the movable unit 172 in a laid down state.

Figure 5C:
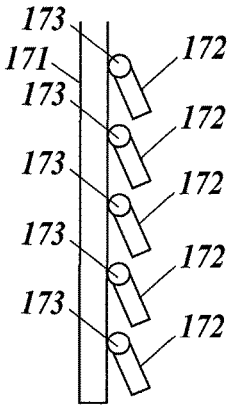
FIG. 5C is a diagram showing a movable unit laid down.

The movable unit 172 can be switched between the first position shown in FIG. 4A, FIG. 4B, and FIG. 5A, and the second position shown in FIG. 4C and FIG. 5C. The first position is the position in which the movable unit 172 is standing toward the fixing belt 161 than the second position. The second position is the position in which the flow of air in the space between the fixing belt 161 is easier than the first position (that is, the position in which the edge (second portion) of the movable unit 172 opposite to the hinge 173 is more separated from the fixing belt 161 than the first position) and the position of the movable units 172 is diagonal along the internal surface of the covering unit 171. For example, the second position is a position in which the angle between the movable unit 172 and the internal surface of the covering unit 171 is about 20 degrees.

The covering unit 171 is provided throughout the width direction of the fixing belt 161. One movable unit 172 can be provided throughout the width direction of the fixing belt 161 or a plurality of movable units 172 can be provided along the width direction of the fixing belt 161.

The movable unit driving unit 3 switches the position of the movable unit 172 between the first position and the second position. That is, the movable unit driving unit 3 functions as the switching unit. The movable unit driving unit 3 includes a rotating actuator (motor, etc.) with a rotating angle of 180 degrees. The movable unit driving unit 3 moves the movable unit 172 to a position so that the edge of the movable unit 172 opposite to the hinge 173 is relatively close to the fixing belt 161 (first position) or a position so that the edge of the movable unit 172 opposite to the hinge 173 is relatively separated from the fixing belt 161 (second position).

The photo-sensor 5 is provided right after the fixing nipping unit on the sheet conveying path in the fixing unit 160, and detects jamming of the sheet conveyed in the fixing unit 160. That is, the photo-sensor 5 functions as the jamming detecting unit.

The controller 10 controls the movable unit driving unit 3. Specifically, when the photo-sensor 5 detects jamming, the controller 10 controls the movable unit driving unit 3 to switch the position of the movable unit 172 from the first position to the second position. The fixing apparatus of the present invention is composed of the controller 10 and the fixing unit 160.

Next, the operation of the fixing unit 160 is described.

According to the second embodiment, when the jamming occurs in the fixing unit 160, the movable unit 172 is tilted.

When the sheet is normally passed (during printing), as shown in FIG. 4A, the controller 10 controls the movable unit driving unit 3 so that the movable unit 172 is in a state standing toward the fixing belt 161 (first position).

For example, if the photo-sensor 5 detects jamming when the coated sheet (60 g/m$^2$) passes, as shown in FIG. 4B, the sheet P may be jammed in between the fixing belt 161 of the fixing unit 160 and the reflecting unit 170. The user opens the front door of the image forming apparatus to remove the jammed sheet P, but in such state, the sheet P is caught by the movable unit 172 and it is difficult to remove the sheet.

Therefore, as shown in FIG. 4C, the controller 10 controls the movable unit driving unit 3 so that the movable unit 172 provided in the internal surface of the covering unit 171 is in a laid down state (second position), and also controls the pressuring/separating unit 2 so that the lower pressure roller 164 pressed against the fixing belt 161 is released, and the sheet can be easily removed. The direction that the movable unit 172 is laid down is a direction so that the tilted movable unit 172 does not prevent the movement of the sheet P when the wound sheet P is removed. That is, the edge opposite of the hinge 173 of the movable unit 172 is laid toward the destination of the sheet P. According to the example shown in FIG. 4C, the user pulls the sheet P to the entrance (sheet entering side) of the fixing unit 160 and removes the sheet P. Therefore, the movable unit 172 is laid to the bottom side.

When jamming is detected, in order to ensure the user's safety in removing the sheet, the controller 10 stops the heaters 165, 166.

In the above description regarding the operation, when the jamming is detected, the movable unit 172 is switched from the first position to the second position. However, similar to the first embodiment, the position of the movable unit 172 can be switched in order to adjust the temperature of the fixing belt 161.

As described above, according to the second embodiment, the position of the movable unit 172 is switched and the temperature of the fixing belt 161 (heating unit) can be suitably controlled. Moreover, by laying down the movable unit 172 there is a space between the fixing belt 161 and the reflecting unit 170. Therefore, when operation to recover from jamming is performed, the sheet can be easily removed, and there is no damage to the fixing belt 161 when the sheet is removed.

When there are a plurality of movable units 172 provided on the internal surface of the covering unit 171, the position of the movable units 172 can be moved together.

Third Embodiment

Next, the third embodiment applying the present invention is described.

The image forming apparatus of the third embodiment has a configuration similar to the image forming apparatus 1 shown in the first embodiment. Therefore, FIG. 1 and FIG. 2 are cited here, and the illustration and the description of the configuration similar to the image forming apparatus 100 are omitted. The characteristic configuration and operation of the third embodiment is described below.

The image forming apparatus of the third embodiment includes a fixing unit 260 instead of the fixing unit 60, and therefore, the fixing unit 60 in the drawings is considered to be the fixing unit 260.

The fixing unit 260 includes a heating unit driving unit 1, a pressuring/separating unit 2, a movable unit driving unit 3, a temperature sensor 4, a photo-sensor 5, etc. (see FIG. 2).

Figure 6A:
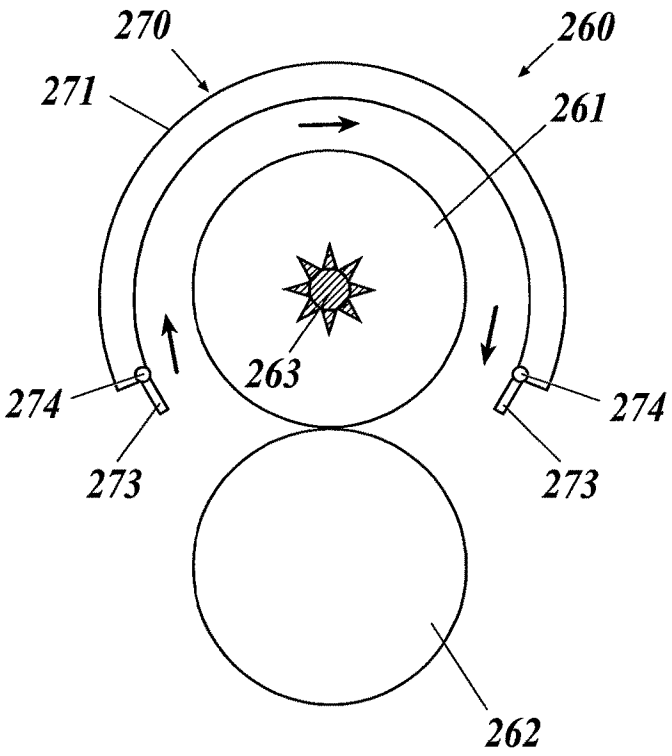
FIG. 6A is a schematic diagram showing a cross-sectional configuration in a center portion of a fixing unit of an image forming apparatus according to the third embodiment.
Figure 6B:
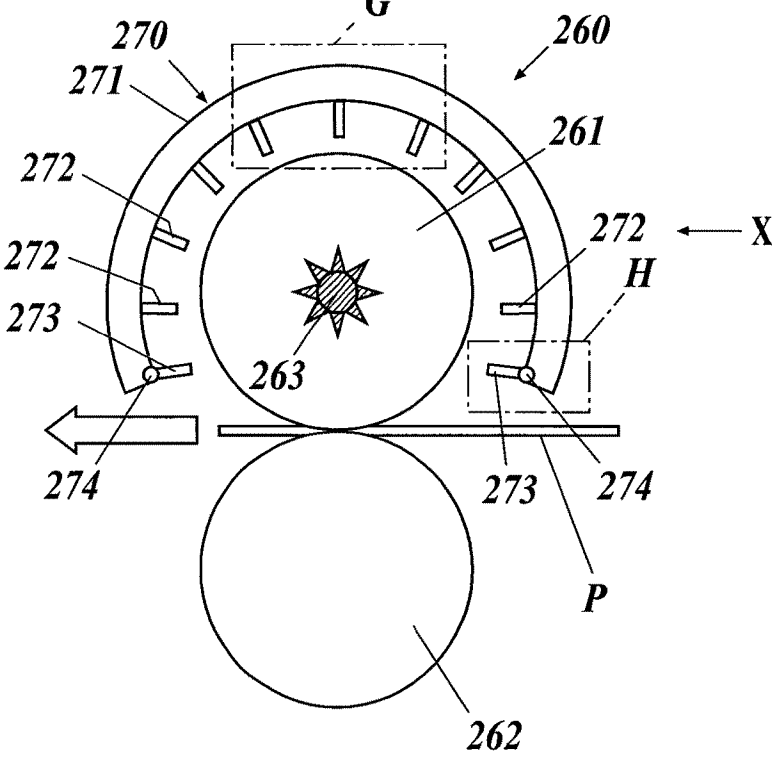
FIG. 6B is a schematic diagram showing a cross-sectional configuration in an edge portion of the fixing unit.

FIG. 6A and FIG. 6B schematically show the configuration of the cross-section of the fixing unit 260.

The fixing unit 260 includes a heating roller 261 as a heating unit, a pressuring roller 262, a reflecting unit 270, and the like.

The heating roller 261 includes an outer surface which is driven to rotate, and comes into contact with the sheet on which toner is transferred to heat the sheet at the fixing temperature. For example, the heating roller 261 is composed of a cylinder core metal with a resin layer made from PTFE, etc. formed on the outer surface. The heaters 263 such as a halogen heater, etc. are provided in the heating roller 261 in a plurality of positions in the axis direction of the heating roller 261. For example, the temperature of the heating roller 261 is controlled within the range of 160 to 200° C.

The heating unit driving unit 1 drives and rotates the heating roller 261. The controller 10 controls the driving of the heating unit driving unit 1.

The heating roller 261 and the pressure roller 262 form a nipping unit and heats and puts pressure on the conveyed sheet.

The pressure roller 262 is pressed to the heating roller 261 by the pressing/separating unit 2. For example, the pressure roller 262 is a cylinder core metal with an elastic layer made from silicon rubber, etc. and a surface layer made from PFA, etc. formed on the outer surface. The controller 10 controls the driving of the pressuring/separating unit 2.

The reflecting unit 270 reflects the heat emitted from the heating roller 261. The reflecting unit 270 includes a covering unit 271 which covers a portion of the outer surface of the heating roller 261 so that there is a predetermined space, and movable units 272, 273 provided in the covering unit 271.

The covering unit 271 includes metal such as stainless steel, and mirror finishing is performed on the internal surface of the covering unit 271.

Figure 7:
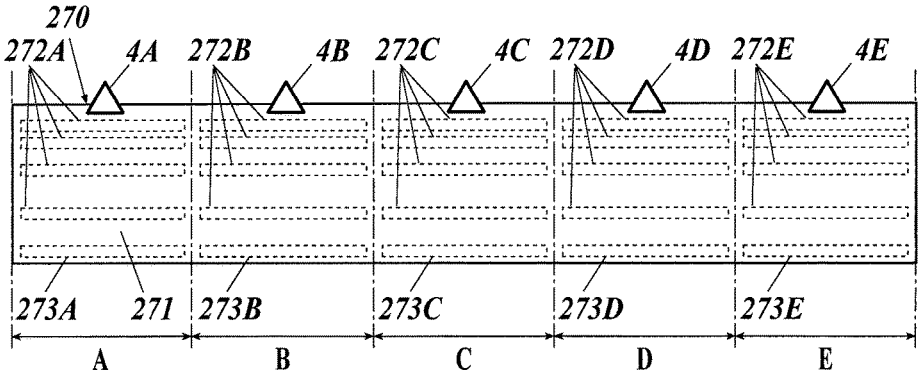
FIG. 7 is a schematic diagram of a reflecting unit viewed from a direction of an arrow X shown in FIG. 6A.

FIG. 7 is a schematic diagram of a reflecting unit 270 viewed from the direction of the arrow X shown in FIG. 6A. The reflecting unit 270 is divided into a plurality of regions A to E along the rotating axis direction (axis direction) of the heating roller 261. The movable units 272 included in the regions A to E are each defined as movable units 272A to 272E, and the movable units 273 included in the regions A to E are each defined as movable units 273A to 273E. The temperature sensors 4 provided in each region of the regions A to E are each defined as temperature sensors 4A to 4E. When only the portion corresponding to the regions A to E applies in the description below regarding the movable units 272, 273 and the temperature sensor 4, A to E is attached to the reference numeral.

The movable units 272, 273 are switched between the first position shown in FIG. 6A and the second position shown in FIG. 6B. The second position is a position which can flow the air more easily in the space than the first position.

Figure 8:
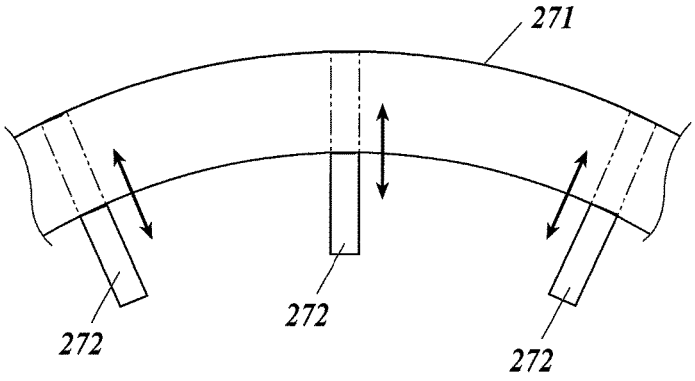
FIG. 8 is an enlarged diagram of a portion G in the reflecting unit shown in FIG. 6A.

FIG. 8 is an enlarged diagram of the portion G in the reflecting unit 270 shown in FIG. 6A.

The movable unit 272 is provided to appear and disappear on the internal surface of the heating roller 261 side of the covering unit 271.

The first position of the movable unit 272 is a position in which the movable unit 272 projects to the heating roller 261 side than the internal surface of the covering unit 271. The second position of the movable unit 272 is a position in which the movable unit 272 retreats in the direction opposite of the heating roller 261 than the first position, and the movable unit 272 is stored inside the covering unit 271.

The movable unit driving unit 3 switches the position of the movable unit 272 between the first position and the second position. That is, the movable unit driving unit 3 functions as the switching unit. The movable unit driving unit 3 which changes the position of the movable unit 272 includes a small linear actuator (solenoid, piston, etc.). The movable unit driving unit 3 moves the movable unit 272 so as to be projecting more (first position) or retreating more (second position) than the internal surface of the covering unit 271.

Figure 9:
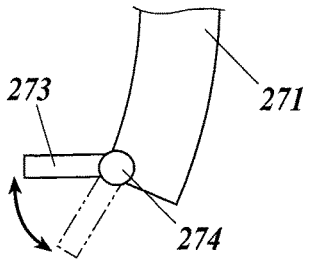
FIG. 9 is an enlarged diagram of a portion H in the reflecting unit shown in FIG. 6A.

FIG. 9 is an enlarged diagram of a portion H in the reflecting unit 270 shown in FIG. 6A.

Similar to the movable unit 72 of the first embodiment, the rotatable unit 273 is provided in an opening of the covering unit 271 rotatable around a portion (first portion, hinge 274) in contact with the covering unit 271 as the axis. The rotating axis of the movable unit 273 is substantially orthogonal to the rotating direction of the heating roller 261.

The first position of the movable unit 273 is a position in which the movable unit 273 is standing toward the heating roller 261 more than the second position. The second position of the movable unit 273 is a position in which the edge (second portion) of the movable unit 273 opposite of the hinge 274 is separated from the heating roller 261 more than the first position, and the movable unit 237 is in a position continuing from the internal surface of the covering unit 271.

The movable unit driving unit 3 switches the movable unit 273 between the first position and the second position. The movable unit driving unit 3 switches the position of the movable unit 273 using the rotating actuator (motor, etc.) with a rotating angle of 60 degrees. With this, the movable unit 273 is moved to the position so that the edge of the movable unit 273 opposite of the hinge 274 is relatively closer to the heating roller 261 (first position) or the position so that the edge of the movable unit 273 opposite of the hinge 274 is relatively separated from the heating roller 261 (second position).

The controller 10 controls the movable unit driving unit 3 for each of the plurality of regions (regions A to E) to switch the movable units 272, 273 included in each region between the first position and the second position. The fixing apparatus of the present invention is composed of the controller 10 and the fixing unit 260.

The storage 80 stores the temperature which is to be the threshold to switch the movable units 272, 273 from the first position to the second position.

Next, the operation of the fixing unit 260 is described.

According to the third embodiment, the positions of the movable units 272, 273 are switched according to the temperature measured for each region A to E.

Figure 10:
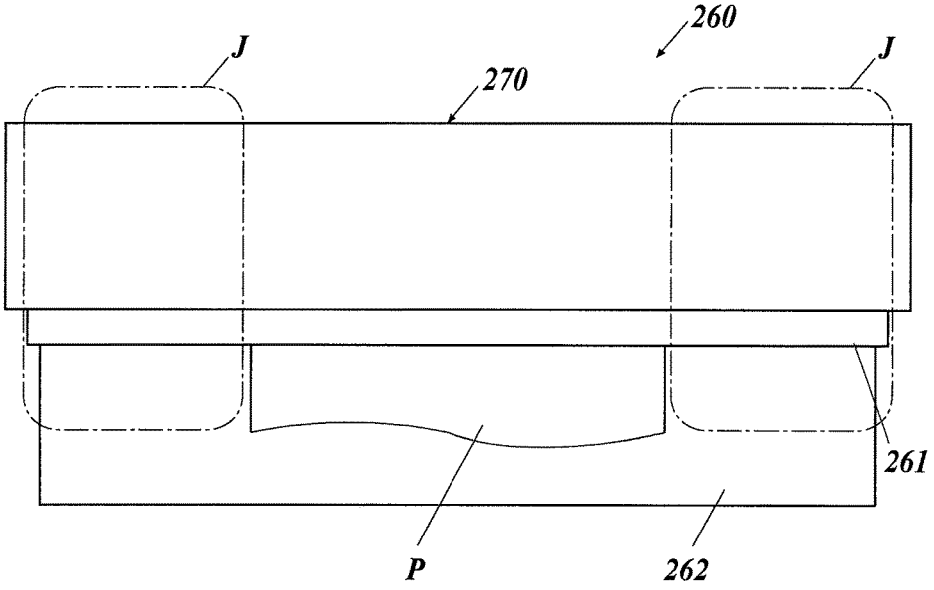
FIG. 10 is a schematic diagram showing a fixing unit viewed from a direction of an arrow X shown in FIG. 6A.

FIG. 10 is a schematic diagram of the fixing unit 260 viewed from the arrow X shown in FIG. 6A.

The sheet P passes the nipping unit formed by the heating roller 261 and the pressure roller 262. When the sheet P with the small size passes, the width of the sheet P is smaller than the width of the heating roller 261. Therefore, the temperature increases in the region J near the edge of the heating roller 261 where the sheet P does not pass.

The controller 10 determines whether the measured temperature reached a predetermined threshold based on the temperature measured by the temperature sensors 4A to 4E provided in the regions A to E. When the measured temperature reaches the threshold, the controller 10 controls the movable unit driving unit 3 to change the position of the movable units 272, 273 included in the region where the temperature reached the threshold from the first position to the second position. For example, when the temperature measured by the temperature sensors 4A, 4E reaches the threshold, the controller 10 moves the movable units 272A, 272E, 273A, 273E to the second position shown in FIG. 6B. Regarding the movable units 272B to 272D, 273B to 273D, when the temperature measured by the temperature sensors 4B to 4D is less than the threshold, the movable units remain in the first position shown in FIG. 6A.

When the movable unit 272 is projecting and the movable unit 273 is standing (first position), the heated air is held between the heating roller 261 and the reflecting unit 270, and the temperature of the heating roller 261 does not easily decrease.

When the movable unit 272 is retreated and the movable unit 273 is laid down (second position), since there is a flow path for the air is made between the heating roller 261 and the reflecting unit 270, the heated air of the entrance side (sheet entering side) of the fixing unit 260 is ejected, and the rise of temperature of the heating roller 261 is suppressed.

As described above, according to the third embodiment, the position of the movable units 272, 273 is switched for each of the plurality of regions (regions A to E), and with this, the temperature of the heating roller 261 (heating unit) can be controlled to a suitable temperature in each region along the rotating axis direction of the heating roller 261. For example, the position of the movable units 272, 273 is switched from the first position to the second position, and with this, the area of the cross section of the flow path of the air can be enlarged partially with the covering unit 271 maintained in the fixed state. As described above, by controlling the flow of air partially between the heating roller 261 and the reflecting unit 270, even when the temperature condition is different depending on the region, the temperature of the heating roller 261 can be accurately controlled.

According to the third embodiment, the third embodiment describes switching the position of the movable units 272, 273 based on the actual temperature measured in each region A to E. Alternatively, the controller 10 can control the movable unit driving unit 3 so that the movable units 272, 273 are switched between the first position and the second position depending on the sheet type of the fixing target.

For example, the storage unit 80 stores information showing whether the sheet passes the regions A to E for each sheet size (width). Depending on the sheet size of the fixing target, the controller 10 sets the movable units 272, 273 included in the region where the sheet passes to be the first position as shown in FIG. 6A and the movable units 272, 273 included in the region where the sheet does not pass to be the second position as shown in FIG. 6B.

Specifically, when the small size sheet P passes, the movable unit 272 corresponding to the edge in the rotating axis direction of the heating roller 261 is retreated and the movable unit 273 corresponding to the edge in the rotating axis direction of the heating roller 261 is laid down so that a flow of air is made and the warm air is ejected. With this, the temperature rising at the edge of the heating roller 261 can be suppressed.

Moreover, depending on the sheet type, the position of the movable units 272, 273 can be switched.

The description of the present embodiment describes an example of a fixing apparatus and an image forming apparatus of the present invention but the present invention is not limited to the above. The detailed configuration and operation of each unit composing the apparatus can be suitably changed without leaving the scope of the present invention.

For example, the characteristic configuration and operation of the present embodiment can be combined.

The first position and the second position of the movable unit are not limited to the positions illustrated in the present embodiment, and any position is possible as long as there is a difference between the first position and the second position regarding the shape of the space formed between the heating unit and the reflecting unit (cross sectional area of the flow path of air).

The above-described embodiment describes an example in which the moving unit switches between the first position and the second position. Alternatively, two or more states can be provided for the position of the movable unit, and the shape of the space between the heating unit and the reflecting unit can be changed step by step.

According to the first embodiment and the second embodiment, the heating unit is the fixing belts 61, 161, and according to the third embodiment, the heating unit is the heating roller 261, but the shape of the heating unit is not limited to the above.

The present U.S. patent application claims priority under the Paris Convention of Japanese Patent Application No. 2015-213573 filed on Oct. 30, 2015 the entirety of which is incorporated herein by reference.

What is claimed is:

1. A fixing apparatus comprising:

a heating unit which includes an outer surface driven to rotate and which heats a sheet on which color material is transferred;

a reflecting unit which reflects heat emitted from the heating unit, wherein the reflecting unit further includes:

a covering unit which covers at least a portion of the outer surface of the heating unit so that there is a predetermined space created between an inner surface of the covering unit and the outer surface of the heating unit; and a movable unit which is provided in the covering unit and which can be switched between a first position and a second position in which air in the predetermined space can flow more easily out of the predetermined space than when the movable unit is in the first position, the movable unit being farther away from the heating unit when the movable unit is in the second position;

a switching unit which switches the movable unit between the first position and the second position; and a controller which controls the switching unit to move the movable unit to the second position when a temperature of the heating unit is being decreased.

2. The fixing apparatus according to claim 1, wherein, the movable unit is provided rotatable around a first portion in contact with the covering unit as an axis; and the second position is a position in which a second portion of the movable unit opposite of the first portion is farther from the heating unit than the first position.

3. The fixing apparatus according to claim 2, wherein, the axis of rotation of the movable unit is substantially orthogonal to a rotating direction of the heating unit.

4. The fixing apparatus according to claim 1, wherein, the movable unit is provided to project and retreat from an internal surface of the covering unit on the heating unit side;

the first position is a position in which the movable unit projects more toward the heating unit than an internal surface of the covering unit; and the second position is a position in which the movable unit retreats to a direction opposite of the heating unit than the first position.

5. The fixing apparatus according to claim 1, wherein, the fixing apparatus comprises a plurality of movable units, the reflecting unit is divided into a plurality of regions along a direction of an axis of rotation of the heating unit; and the controller controls the switching unit to switch one movable unit of the plurality of movable units included in each region between the first position and the second position for each region of the plurality of regions.

6. The fixing apparatus according to claim 1, wherein, the controller controls the switching unit to switch the movable unit from the first position to the second position when the temperature of the heating unit is being decreased.

7. The fixing apparatus according to claim 1, further comprising a jamming detecting unit which detects jamming of a sheet conveyed in the fixing apparatus, wherein, the controller controls the switching unit to switch the movable unit from the first position to the second position when the jamming detecting unit detects jamming.

8. The fixing apparatus according to claim 1, wherein, the controller controls the switching unit to switch the movable unit between the first position and the second position depending on a type of the sheet as a target of fixing.

9. An image forming apparatus comprising the fixing apparatus according to claim 1.

* * * * *